United States Patent [19]

Simons

[11] Patent Number: 5,016,813

[45] Date of Patent: May 21, 1991

[54] FOLD-UP CONTAINER AND CONSTRUCTION METHOD

[76] Inventor: Einar L. E. Simons, Aptdo. N°55-0374, Panama, Panama

[21] Appl. No.: 486,791

[22] Filed: Mar. 1, 1990

[51] Int. Cl.[5] ..... B65D 5/20

[52] U.S. Cl. ..... 229/189

[58] Field of Search ..... 229/189, 198, 920; 383/74

[56] References Cited

U.S. PATENT DOCUMENTS

| | | | |
|---|---|---|---|
| 117,833 | 11/1939 | Laine . | |
| 170,991 | 12/1875 | Conover . | |
| 268,542 | 12/1882 | Ruckert | 229/189 |
| 396,570 | 1/1889 | Hotchkiss | 229/189 |
| 888,653 | 5/1908 | Potter | 229/189 |
| 993,919 | 5/1911 | Wagnitz | 229/189 |
| 1,064,124 | 6/1913 | Beaumont . | |
| 1,150,105 | 8/1915 | Emmons | 229/189 |
| 1,392,110 | 9/1921 | Blascheck . | |
| 1,467,690 | 9/1923 | Schwarz | 229/189 |
| 1,918,375 | 7/1933 | Bowersock et al. . | |
| 1,959,613 | 5/1934 | Carson . | |
| 2,020,196 | 11/1935 | Mallgraf . | |
| 2,643,812 | 6/1953 | Lange . | |
| 2,792,165 | 5/1957 | Thompson . | |
| 2,907,513 | 10/1959 | Thiolat | 229/189 |
| 3,019,957 | 2/1962 | Palmer | 229/920 |
| 3,097,782 | 7/1963 | Koropatkin et al. | 229/189 |
| 3,140,037 | 7/1964 | Baum et al. . | |
| 3,207,357 | 9/1965 | Schmitt . | |
| 3,315,868 | 4/1967 | Hempfling . | |
| 4,019,675 | 4/1977 | Andersson et al. . | |
| 4,509,645 | 4/1985 | Hotta | 229/189 |
| 4,608,799 | 9/1986 | Hasegawa . | |
| 4,643,349 | 2/1987 | Sheffer . | |
| 4,643,697 | 2/1987 | Sheffer . | |

*Primary Examiner*—Gary E. Elkins

*Attorney, Agent, or Firm*—Woodard, Emhardt, Naughton, Moriarty & McNett

[57] ABSTRACT

A fold-up and knock-down structure for ease of storage, handling and shipment includes an originating substantially flat form arranged with a plurality of panels defined by score lines, the score lines defining a generally rectangular base panel and four generally rectangular side panels. Disposed between each pair of side panels are corner panels which are additionally subdivided by score line into generally triangular corner sections. Each of the corner sections and each of the side panels include apertures to enable the threading therethrough of a strap or cord, the free ends of which are secured so as to hold the structure in its folded-up configuration. The strap or cords may then be released and the folded-up structure returned to its originating flat form and reused.

19 Claims, 14 Drawing Sheets

FOLD-UP CONTAINER AND CONSTRUCTION METHOD

BACKGROUND OF THE INVENTION

The present invention relates in general to the construction of containers and receptacles which begin in a flat cardboard form and include score lines for folding into an upright free-standing configuration. More particularly, the present invention relates to how such fold-up containers may be made liquid-tight and secured in their folded three-dimensional form using a flexible tie, such as a strap, cable, string or cord.

The use of flat cardboard forms with fold (score) lines as a means to direct conversion of a flat (two-dimension) form into a three-dimensional stand-alone structure is well known. For example, the following patents show different structures which can be created by folding an originally flat form of cardboard into some object such as a toy house:

| U.S. Pat. No. | Patentee | Issue Date |
|---|---|---|
| 4,643,697 | Sheffer | 02/17/1987 |
| 4,643,349 | Sheffer | 02/17/1987 |
| 4,608,799 | Hasegawa | 09/02/1986 |
| 3,315,868 | Hempfling | 04/25/1967 |
| 2,020,196 | Mallgraf | 11/05/1935 |
| 1,918,375 | Bowersock et al. | 07/18/1933 |
| 1,064,124 | Beaumont | 06/10/1913 |

In each of the foregoing listed patents, the cardboard is folded and interconnected with tabs and slots in order to establish and maintain the free-standing, three-dimensional form for the container or structure.

In yet another group of prior references, the originating flat form of cardboard is folded along the score lines and secured by cord, cable, string or similar strap so as to maintain the three-dimensional form. Representative of this construction approach are the following patents:

| U.S. Pat. No. | Patentee | Issue Date |
|---|---|---|
| Des. 117,833 | Laine | 11/28/1939 |
| 1,392,110 | Blascheck | 09/27/1921 |

In those designs where a string, cord or strap is used to secure the folded flat form into a three-dimensional shape, a couple of different techniques are employed. The general idea is to thread a flexible cord through some or all of the folded-together portions and secure the free ends of the cord so that the folded, upright condition is maintained.

While one desirable feature of the prior references is the convenience of packaging, handling and shipping of flat forms over three-dimensional structures, one concern is how to adequately seal the edges and corners in order to make any container or receptacle of this type liquid-tight. Another concern is how to securely hold the form in its folded-up configuration so the container sides do not collapse under the weight and pressure of the contents. This will be a concern whether the contents are liquid thereby exerting a constant pressure on the side walls or dry material which may exert pressure as the load shifts during any handling or transportation.

Even if the objective in certain instances is not to create a liquid-tight container, it is important to create a rigid and strong container such that regardless of the contents, the three-dimensional form is maintained and the contents retained in their intended manner.

In designs represented by certain prior references, the corners of square or rectangular containers are created by a plurality of folds of triangular web sections. Typical of this design approach are the structures disclosed by the following patents:

| U.S. Pat. No. | Patentee | Issue Date |
|---|---|---|
| 4,019,675 | Andersson et al. | 04/26/1977 |
| 3,207,357 | Schmitt | 09/21/1965 |
| 3,140,037 | Baum et al. | 07/07/1964 |
| 2,792,165 | Thompson | 05/14/1957 |
| 2,643,812 | Lange | 06/30/1953 |
| 1,959,613 | Carson | 05/22/1934 |
| 170,991 | Conover | 12/14/1875 |

While a wide range and variety of construction options and configurations are disclosed by the foregoing references, the present invention provides a unique and novel combination of construction features heretofore not utilized. Virtually any flat-fold cardboard structure will provide the benefits of ease of shipping, handling and storage, due simply to its flat, two-dimensional form enabling easy stacking and conservation of space. The real value though of a particular construction design is found in the manner of converting or transforming the generally two-dimensional form into its stand-alone three-dimensional shape and in the strength, rigidity and durability of the final formed container or receptacle, whether for liquid retention or dry storage.

Another concern with fold-up containers of this type is that if they are designed as they are often are to be reusable, there are certain benefits to be derived by the ease or quickness of creating the folded-up shape as well as the ease or quickness in collapsing the three-dimensional form back to its flat form. For this reason, flat-form cardboard containers which are folded along score lines but then stapled or glued to hold their three dimensional form do not provide acceptable options for reusable containers. Anyone who has tried to disassemble a cardboard box which has been glued or stapled knows the difficulties and the fact that one or more of the cardboard panels or flaps typically tear to the point that they are unusable. For this reason the present invention focuses on the use of securing arrangements for the three-dimensional form which can be reversed so as to return the container to its flat form without any destruction of the container or partial destruction such that it is returned to its original form without any noticeable adverse side effects.

Regarding what is disclosed by the prior references and understanding what is desired for this type of container construction, the present invention is not anticipated by any prior reference and is unobvious over any prior reference or combination of references.

SUMMARY OF THE INVENTION

A fold-up and knock-down container which begins in a flat form and can be manually folded into an upright structure and unfolded into the originating flat form and which is suitable to contain either dry or liquid contents according to one embodiment of the present invention comprises a main body arranged with a plurality of panels defined by score lines which denote folds to be made in the main body, the plurality of panels including a base panel, four side panels and four corner panels, each of which are arranged with a plurality of sections defined by score lines which denote folds to be made in the corresponding panels and flexible tieing means threaded through each of the corner sections for drawing together and securing the corner sections of each corner panel into a vertical corner as part of the folded-up container.

One object of the present invention is to provide an improved fold-up and knock-down container.

Related objects and advantages of the present invention will be apparent from the following description.

DESCRIPTION OF THE PREFERRED EMBODIMENT

Figure 1:
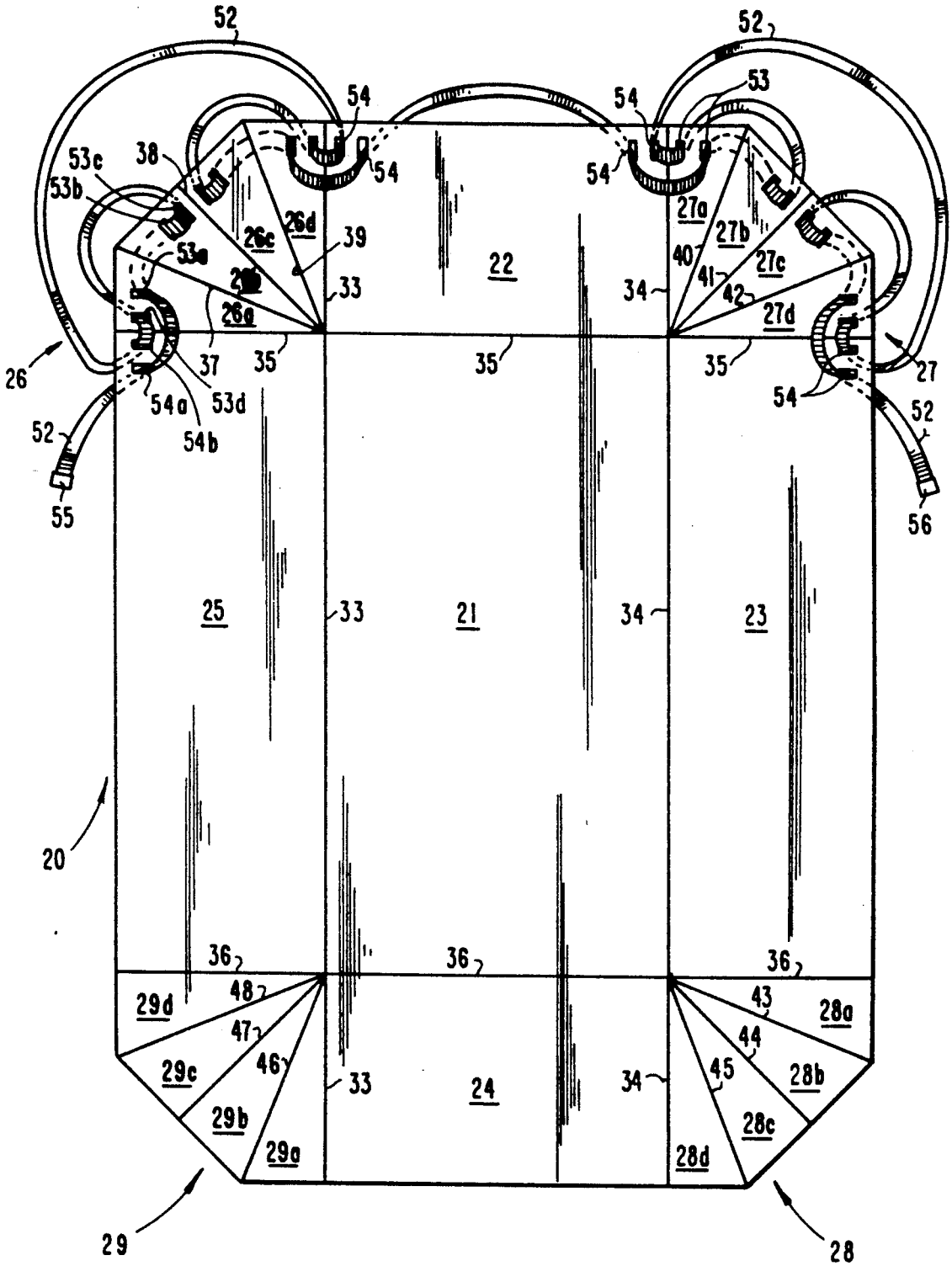
FIG. 1 is a top plan view in flat form, unfolded condition of a fold-up and knock-down container according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
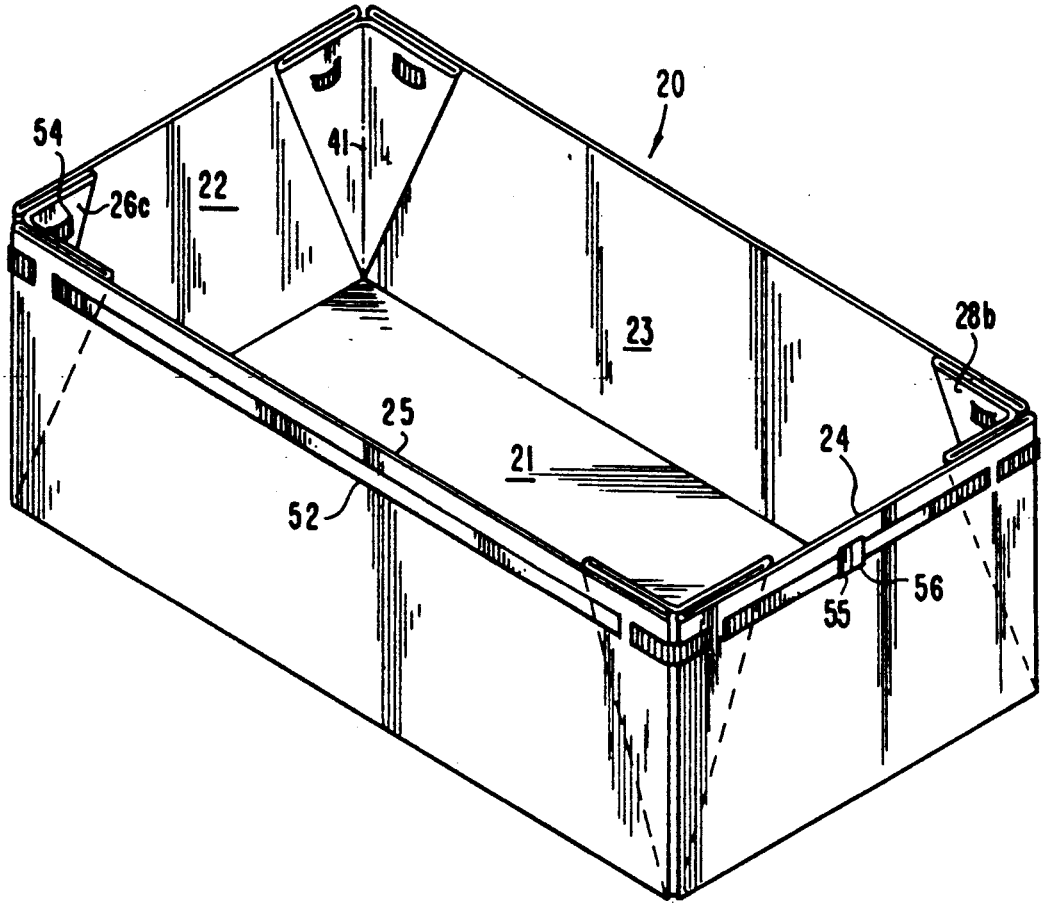
FIG. 2 is a perspective view of the FIG. 1 container in its folded-up and secured three-dimensional form.

Referring to FIGS. 1 and 2, there is illustrated a fold-up container 20 which begins in a flat form (FIG. 1) and is arranged with a plurality of panels defined by score lines. The panels include a generally rectangular base panel 21, four generally rectangular side panels 22–25, and four corner panels 26–29. Each corner panel is configured with four generally triangular sections which are defined by score lines. For the sake of simplicity, the triangular sections **26*a*–26*d*, 27*a*–27*d*, 28*a*–28*d* and 29*a*–29*d*** are identified by lower case letters using the base number of the corresponding corner panel.

The score lines for the base and side panels include substantially parallel lines 33 and 34 and substantially parallel lines 35 and 36 which are additionally substantially perpendicular to score lines 33 and 34 as would be expected for a base and side panels which are generally rectangular. Score lines 37, 38 and 39 separate corner panel 26 into sections **26*a*–26*d*. Score lines 40, 41 and 42 separate corner panel 27 into sections 27*a*–27*d*. Score lines 43, 44 and 45 separate corner panel 28** into sections 28a–28d. Score lines 46, 47 and 48 separate corner panel 29 into section 29a–29d.

In folding the flat form of FIG. 1 into the free-standing container 20 of FIG. 2, the four side panels 22–25 are folded up and in toward base 21. The four corners are folded as illustrated in FIG. 2 wherein the center score lines 38, 41, 44 and 47 become the vertical corner edge of the container while the two sections on each side of the center score lines are folded back on themselves and overlap the adjacent side panel thereby creating a triple thickness as is illustrated. This approach is followed in folding up each of the four corners in a symmetrical fashion such that when explaining and understanding the construction technique, reference to one corner of the folded-up container should suffice for an understanding of what occurs at each corner due to their virtual identity.

In order to hold the folded-up form of container 20, a flexible tie such as strap 52 which may alternatively be a length of cord, string or cable is threaded or woven through apertures 53 in the corner sections, there being a pair of apertures 53 in each section of each corner panel. These various apertures are configured as generally oblong slots and while it is important for the spacing to be the same between each pair of apertures primarily for ease of assembly and appearance symmetry, the actual spacing is a variable. Although in FIGS. 1 and 2, the threading of strap 52 through the various apertures of corner panel 26 is illustrated in detail, the threading through of strap 52 in corner panels 27, 28 and 29 has not been fully illustrated simply for drawing clarity and simplicity, though it should be understood as mentioned above that the method and orientation for threading strap 52 through corner panel 26 will be the same for corner panels 27, 28 and 29. While the corner sections of each corner panel include two slot-like apertures 53, each of the side panels 22–25 also include two pairs of slot-like apertures 54 with one pair in close proximity to corner section d and the other pair in close proximity to corner section a. Please note at this point the lower case letter suffixes are being used in a generic sense in that the arrangement of apertures 54 is the same through all side panels of container 20.

Strap 52 is a single, continuous length of cord, string or cable material and includes a buckle latch half 55 and 56 at each free end. These latch halves are designed to interconnect with each other on the exterior of the container in order to maintain the folded-up form.

Strap 52 is only illustrated in partial form in FIG. 1 for drawing clarity and simplicity but is illustrated in complete form as buckled together around the perimeter of the container in FIG. 2.

Threading of strap 52 through the various apertures 53 and 54 is the same at each corner panel and the following description begins with corner panel 26. The strap 52 is first threaded from the exterior of the container into aperture 54a and then from the inside out through aperture 53a. From here the strap is threaded into one aperture 53b of section 26b and back out the other aperture 53c of section 26b, back into aperture 53d and back out through aperture 54b. An understanding of the threading of strap 52 can be aided by recognizing that when the various folds are made in the corner panels and side panels, panel 25 is in an overlapping stack with sections 26a and 26b and apertures 54a, 53a and 53b are in alignment with each other and the strap goes through these three in a straight-in fashion. The strap then makes a 180 degree turn or bend and exits back out through another group of three aligned apertures including apertures 53c, 53d and 54b. This constitutes the strap threading for one end on one side panel and one half of the folded corner. The strap then winds around the outside of the folded-up corner and in effect repeats the threading procedure with the overlapping of sections 26c, 26d and side panel 22. Broken line illustrations are used in FIG. 1 for strap 52 in order to help clarify its route while being threaded through the various apertures 53 and 54. A careful review of FIG. 2 shows the routing of the strap as well as the overlapping stack of corner sections and side panels. FIG. 2 also illustrates the securement of halves 55 and 56 together after all corners are threaded by strap 52.

One aspect of container 20 is that since we begin with a continuous panel or sheet of material, with the exception of apertures 53 and 54, which are close to the outer edge and thus at the upper margin when folded, there are no openings or seams that would allow liquid contents to leak out. The material used for container 20 can be metal, plastic, cardboard (with or without a waterproof coating such as wax) or paper. The specific material and its gauge or thickness is determined based upon the intended contents for the container, the size of container and the use which will be made of the container. If a liquid is to be held for any length of time then some type of waterproof material, waterproofing lamination or coating is needed. A lamination of materials may also be used for property enhancement such as combining strength and flexibility and waterproof properties. If the contents are dry, then any material would be suitable and if the contents are heavy, then a thicker material is needed for appropriate strength and rigidity. While the multiple lamination folds constituting each corner not only provides a liquid-tight corner but also provides a stiff vertical rib at the end of each side panel which gives great strength and rigidity to the overall container.

The use of strap 52 not only holds the folded-up configuration for container 20 but provides a means for the quick and easy disassembly merely by unbuckling the latch halves 55 and 56 and unthreading strap 52. In this manner of disassembly, the originating flat form of container 20 can be recaptured. This particular approach allows the container 20 to be stored and shipped in the flat form in order to conserve space and ease handling. When a container is required, the folds are made along the score lines the strap 52 threaded and the container created. It is also envisioned that the strap 52 may be partially threaded through a portion of the corners and side panels and then that process completed as the container is formed. The use of strap 52 precludes the need for any staples or adhesive so that the container can be reused over and over again. A further advantage is that if the strap 52 is lost or broken, a replacement strap can be provided thereby saving the container and avoiding the need to destroy or scrap the entire container simply for the loss of one cable or strap.

The structure of container 20 in FIGS. 1 and 2 represents one possible arrangement for strap 52 and its utilization for holding together container 20 in its folded-up form. In lieu of one length of strap, it is envisioned that two or four or eight lenghts of strap or cord material could be used without changing the configuration of the base, side panels and corner sections of container 20 including the number and location of apertures 53 and 54. Alternative embodiments are illustrated in FIGS. 3–25 and in each configuration for container 20, the panels, sections and score lines are the same as that illustrated in FIG. 1. The similarity or virtual identity in the configuration of the containers of these various figures includes the triple thickness of side panel and two corner sections as folded such that the apertures are aligned allowing the strap or length of cord to be threaded through this lamination as was described with reference to FIGS. 1 and 2.

The primary difference between the container designs of FIGS. 3–25 and container 20 as illustrated in FIGS. 1 and 2 is in the number of straps used and how the free ends of each length of strap or cord is secured. Since reference to container 20 is intended to be the final assembled form of the container and main body 21 refers simply to the flat form material without the strap, new reference numerals will be used to identify the finished containers of FIGS. 3–25. However, as mentioned above, it should be understood that the main body will be virtually identical to that illustrated in FIG. 1 in every instance though in a few of the embodiments, an additional aperture or feature is included. Later with reference to FIG. 27, the side panel and corner section geometry will be described and it should be understood that this description will apply to all of the embodiments.

Figure 3:
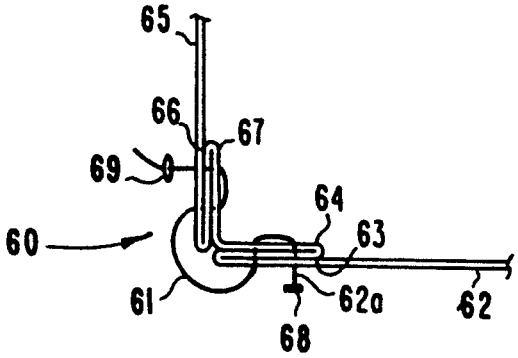
FIG. 3 is a diagrammatic top plan view of one corner of the FIG. 1 container illustrating an alternative securing method.
Figure 4:
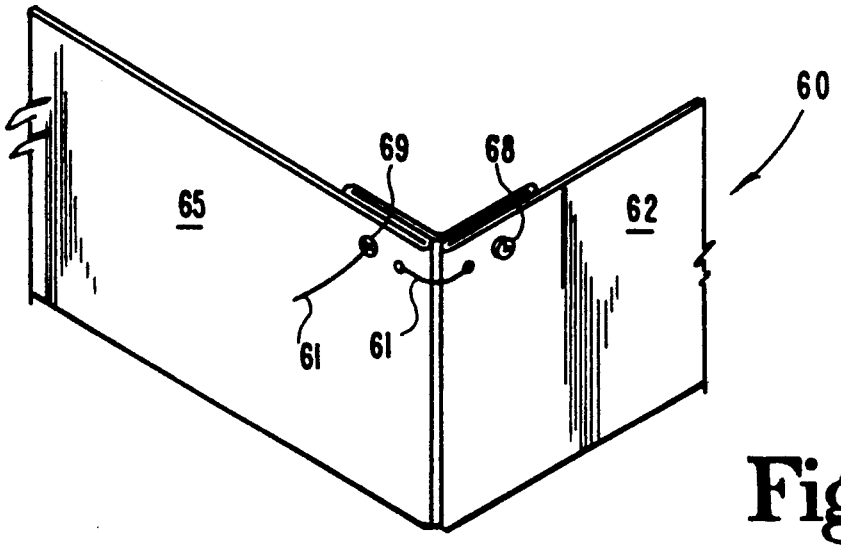
FIG. 4 is a perspective view of the FIG. 3 container corner.

Referring to FIGS. 3 and 4, only one corner of container 60 is illustrated wherein the top plan view of FIG. 3 is a diagrammatic illustration of how the strap 61 is threaded through side panel 62 and the two layers 63 and 64 of the corner panel and through side panel 65 and the two layers 66 and 67 of the corner panel. Reference to two layers 63 and 64 and the two layers 66 and 67 are in fact the four corner sections of the illustrated corner, though in the diagrammatic top plan view they appear simply as thicknesses or layers of material. In this embodiment, one end of strap 61 is securely fitted with a washer 68 whose diameter size is larger than the diameter or width of aperture 62*a* in side panel 62. The opposite end of strap 61 is equipped a slide choker 69 which can be manually slipped along strap 61 in order to pull tight the folded configuration of the corresponding corner. Once all of the threading is done, the choker 69 is pulled tight on the strap 61 and when released holds its position and securely holds the corner in the upright folded configuration. FIG. 4 is a perspective view of the corner assembly as just described showing the approximate location for washer 68 and choker 69 and a short length of strap 61 extending from choker 69.

Figure 5:
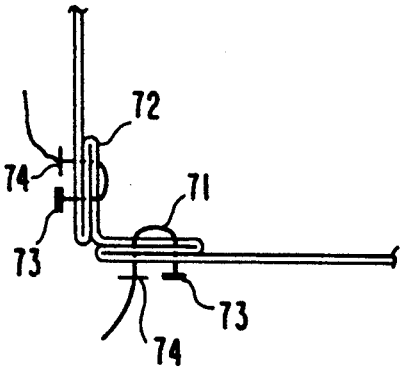
FIG. 5 is a diagrammatic top plan view of one corner of the FIG. 1 container illustrating an alternative securing method.
Figure 6:
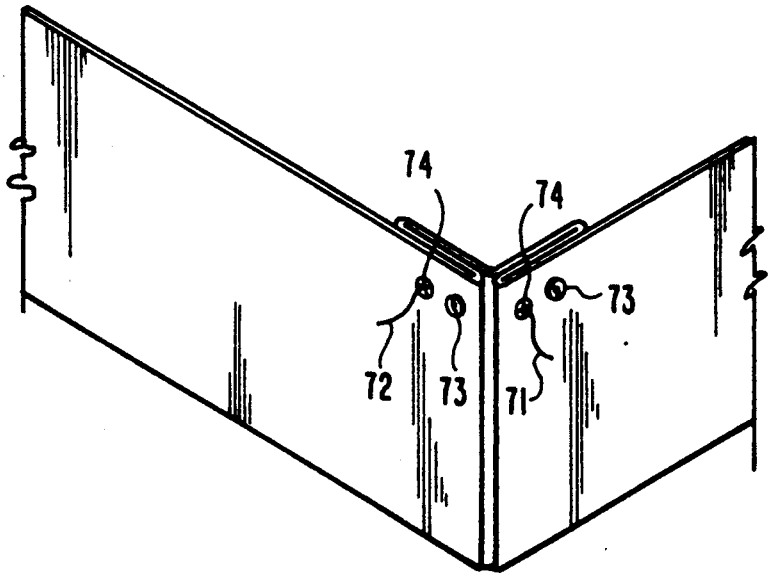
FIG. 6 is a perspective view of the FIG. 5 container corner.

Referring to FIGS. 5 and 6, the same approach as used for FIGS. 3 and 4 is illustrated except that instead of a single strap 61 there ar two separate straps 71 and 72 each including a washer 73 at one free end and a choker 74 along the opposite end of the strap. Otherwise, the threading and utilization of straps 71 and 72 with washers and choker 73 and 74, respectively, is the same as that illustrated with regard to FIG. 3. Likewise, FIG. 6 is a perspective view of the illustrated corner in FIG. 5 showing the approximate location of the two washers and the two chokers and how corresponding lengths of strap 71 and 72 are extending from the end of the chokers. As would be understood, the FIG. 3 arrangement will employ four separate straps each with one washer and one choker. In the FIG. 5 arrangement there will be eight straps each with a washer and choker.

Figure 7:
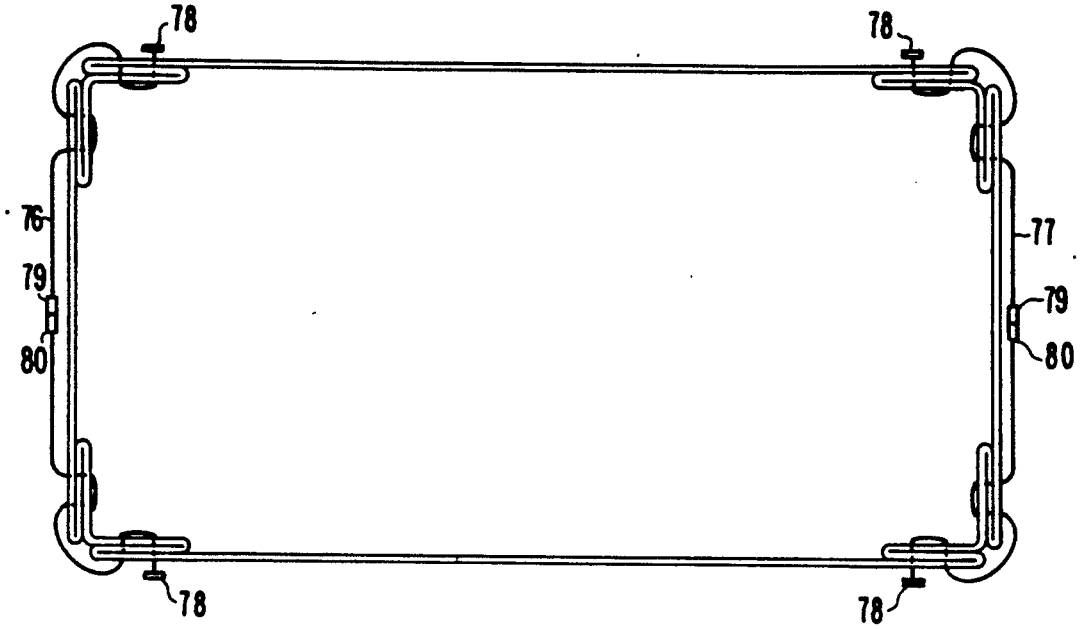
FIG. 7 is diagrammatic top plan view of the FIG. 1 container illustrating alternative tieing arrangements for securing the container in three-dimensional form.
Figure 8:
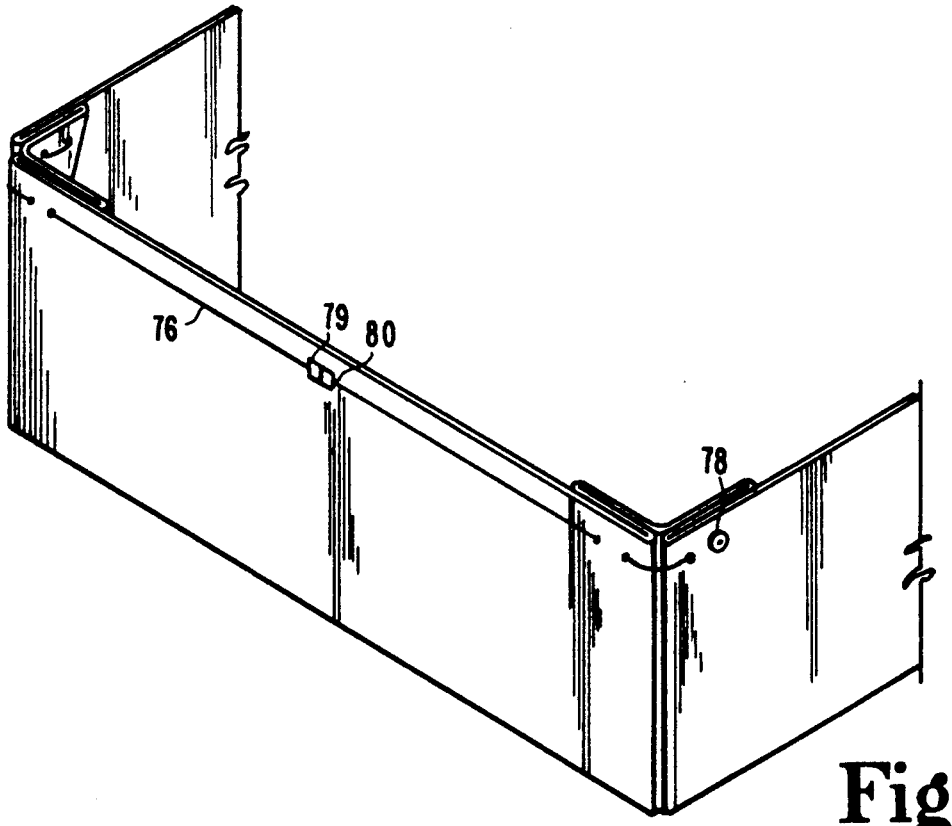
FIG. 8 is a partial perspective view of the FIG. 1 container using the FIG. 7 securing means.

Referring to FIGS. 7 and 8, a slightly different arrangement is employed for straps 76 and 77. Straps 76 and 77 each include two separate lengths having the aforementioned washer 78 disposed at one free end and at the opposite end a pair of buckle latch halves 79 and 80 which are joined together in the manner described with regard to FIG. 2 so as to secure in the folded-together upright form a corresponding one half or side of the container. The identical approach is used on each side with two washers 78 disposed at the free ends of the two lengths of strap comprising strap 77 and the opposite free ends of these two lengths are assembled together by the buckle or latch approach utilizing halves 79 and 80. FIG. 8 is a partial perspective view of the FIG. 7 diagrammatic assembly.

Figure 9:
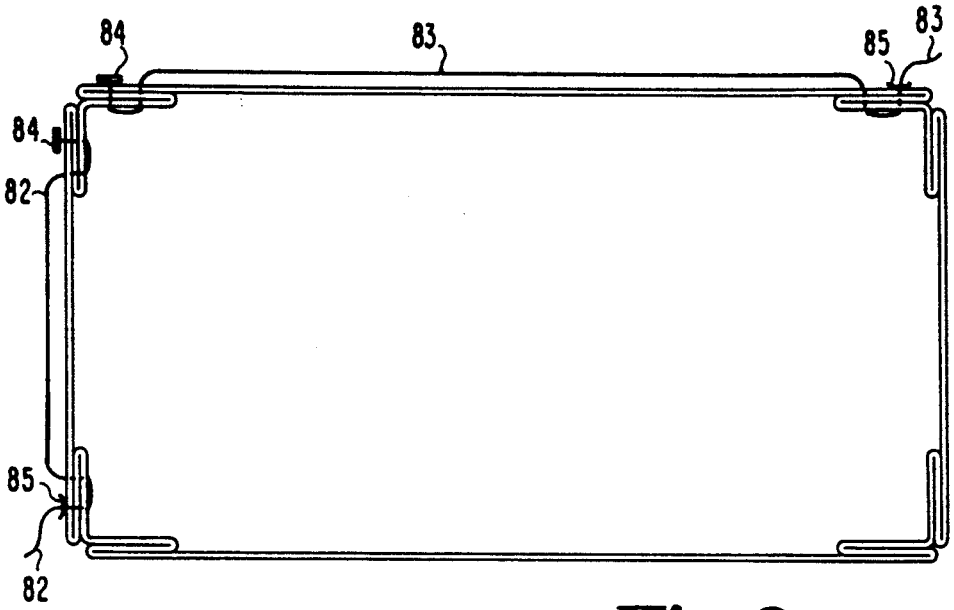
FIG. 9 diagrammatic top plan view of the FIG. 1 container illustrating alternative tieing arrangements for securing the container in three-dimensional form.
Figure 10:
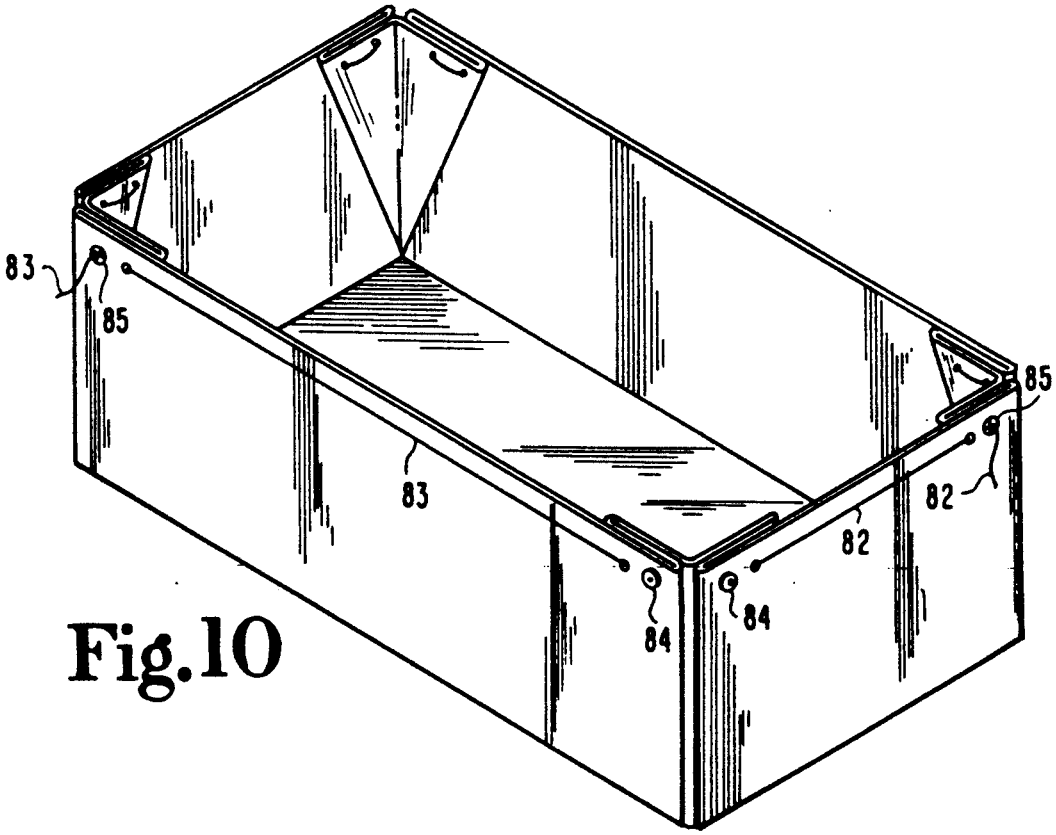
FIG. 10 is a partial perspective view of the FIG. 9 container using the FIG. 9 securing means.

Referring to FIGS. 9 and 10, a still further embodiment is disclosed with regard to how the strap is utilized to hold the container in its folded upright configuration. With regard to FIG. 9, two straps 82 and 83 are illustrated though it should be understood and as illustrated in FIG. 10, there are in fact four such straps utilized in the final assembly for the container. In the embodiment of FIG. 9, we returned to the washer and choker utilization wherein one free end of cable 82 includes washer 84 and the opposite end includes choker 85. A similar arrangement is utilized with regard to strap 83 which also includes washer 84 at one free end and choker 85 at the opposite free end and in both instances. The extending length of straps 82 and 83, denote the fact that the choker 85 can be manually moved along the length of the strap to a tightened position and then will hold that position in order to retain the container in the folded form. As is illustrated in FIG. 9, the fold of each corner into its two halves is then split as to which strap holds which corner or which portion of each corner in the folded-up configuration. As can be seen for example, strap 82 threads through half of one corner fold and through half of the opposite corner fold for the same side panel. This is symmetrically repeated throughout the four side panels of the container of FIG. 9 as is illustrated in FIG. 10.

Figure 11:
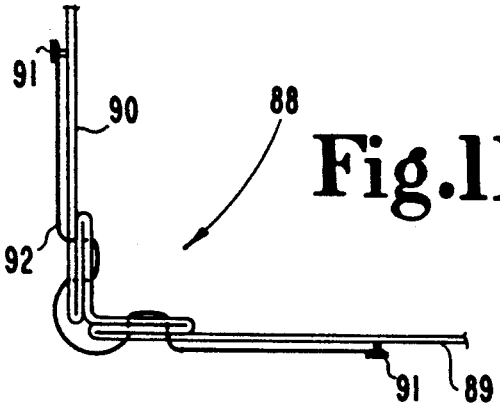
FIG. 11 is a diagrammatic top plan view of one corner of the FIG. 1 container illustrating an alternative securing method.
Figure 12:
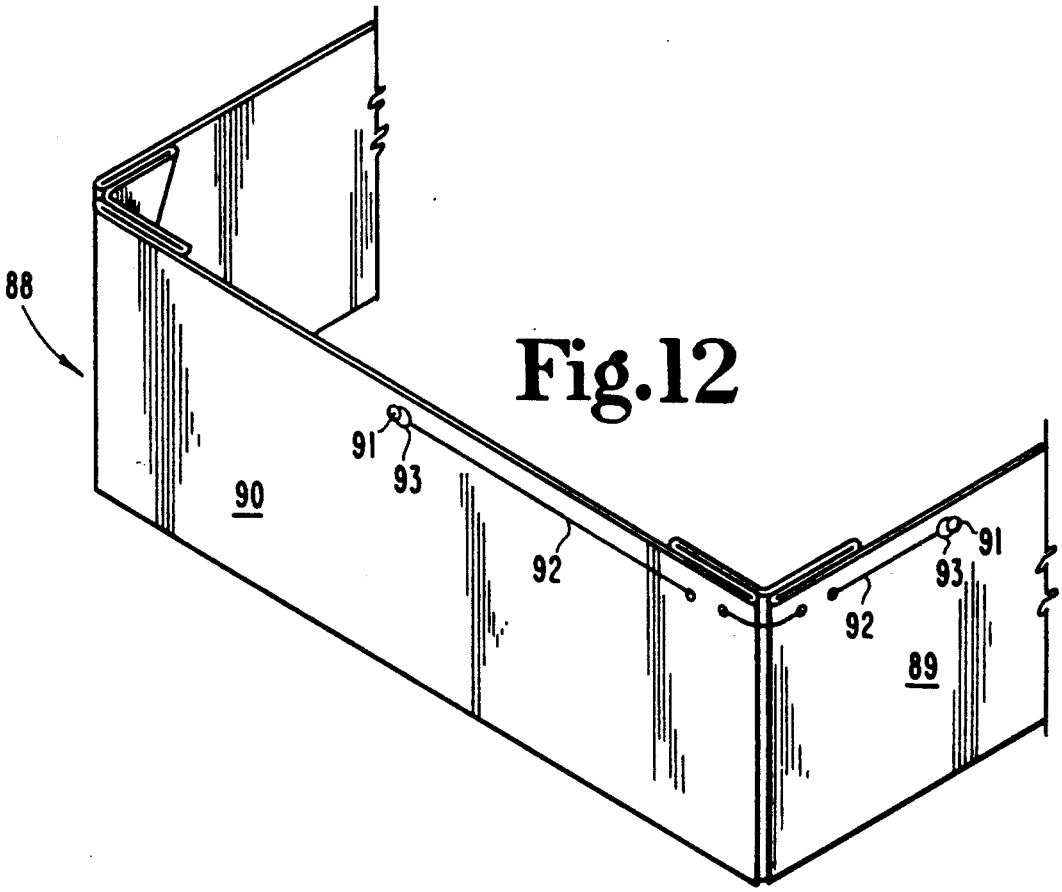
FIG. 12 is a perspective view of the FIG. 11 container corner.

Referring to FIGS. 11 and 12, a slightly different arrangement is utilized for container 88 wherein adjacent side panels 89 and 90 are fitted with a button 91 which may be similar to a thumbtack or pin forcibly inserted into the side panels 89 and 90 and rigidly held in place. These buttons are utilized by designing the securing strap 92 with rings 93 at each free end. The apertures in the corner sections and side panels are sized to enable the rings to pass therethrough when turned on axis. The cord can also be permanently threaded and the rings can serve as a means of not permitting the cord to be unthreaded so the cord cannot be lost. The rings can be attached after the cord is threaded. When the threading of each corner is completed, the strap 92 is pulled tight whereby each ring 93 is able to slide over the corresponding side panel buttons 91. In order to insure a tight securement for each folded-up corner, it is important to precisely place the buttons at a point along the respective side panels relative to the length of the strap 92. It may be necessary to slightly push in on the side panels so as to reduce the overall length required for the cable so that the two rings can easily hook over the corresponding two buttons. When the container folds back to its more vertical form, there is a tight securement around the corner holding the desired shape.

Figure 13:
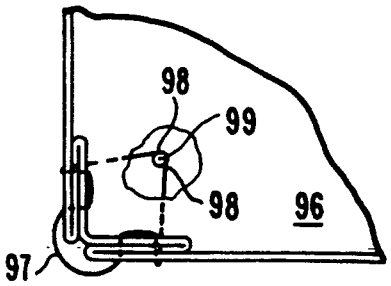
FIG. 13 is a diagrammatic top plan view of one corner of the FIG. 1 container illustrating an alternative securing method.
Figure 14:
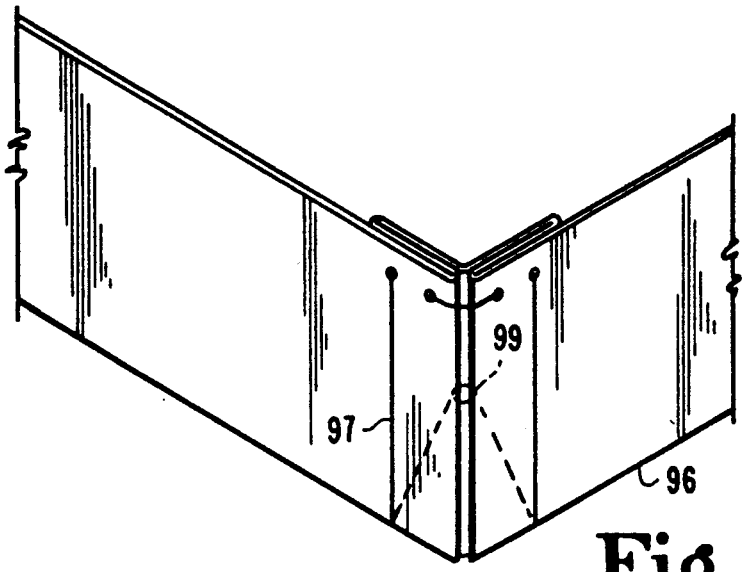
FIG. 14 is a perspective view of the FIG. 13 container corner.

Referring to FIGS. 13 and 14, the same button and ring configuration as illustrated with regard to FIGS. 11 and 12 is employed except in this instance only a single button is used and it disposed on the underside of base panel 96. As should be understood from what has been described with regard to FIG. 11, strap 97 is a continuous length, flexible member having rings 98 secured to each end. Button 99 which is anchored on the underside of base panel 96 is positioned relative to the length of strap 97 such that after the threading of the corner is completed as illustrated in FIG. 13, the two rings 98 are drawn into alignment and hooked over button 99. This is repeated for each of the other three corners.

Figure 15:
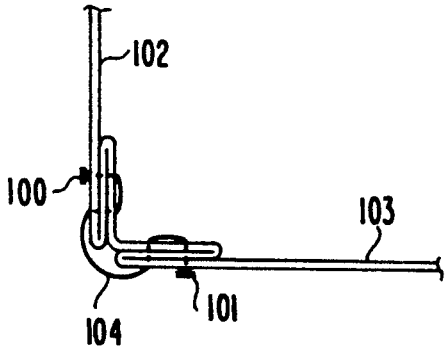
FIG. 15 is a diagrammatic top plan view of one corner of the FIG. 1 container illustrating an alternative securing method.
Figure 16:
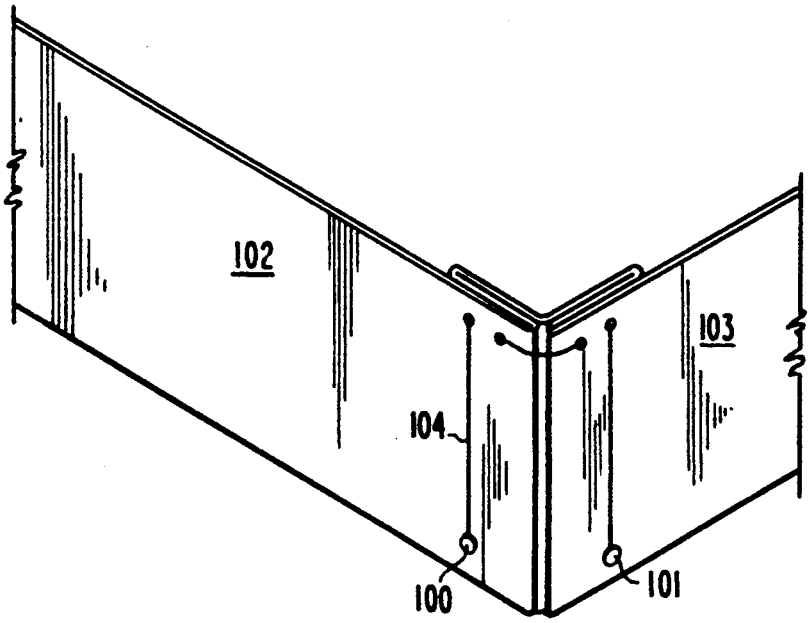
FIG. 16 is a perspective view of the FIG. 15 container corner.
Figure 17:
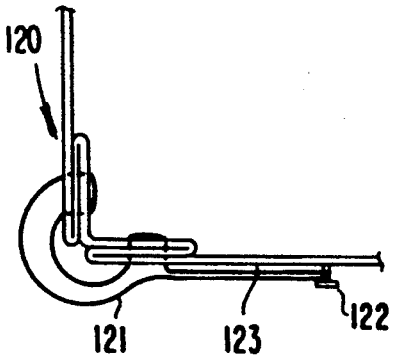
FIG. 17 is a diagrammatic top plan view of one corner of the FIG. 1 container illustrating an alternative securing method.
Figure 18:
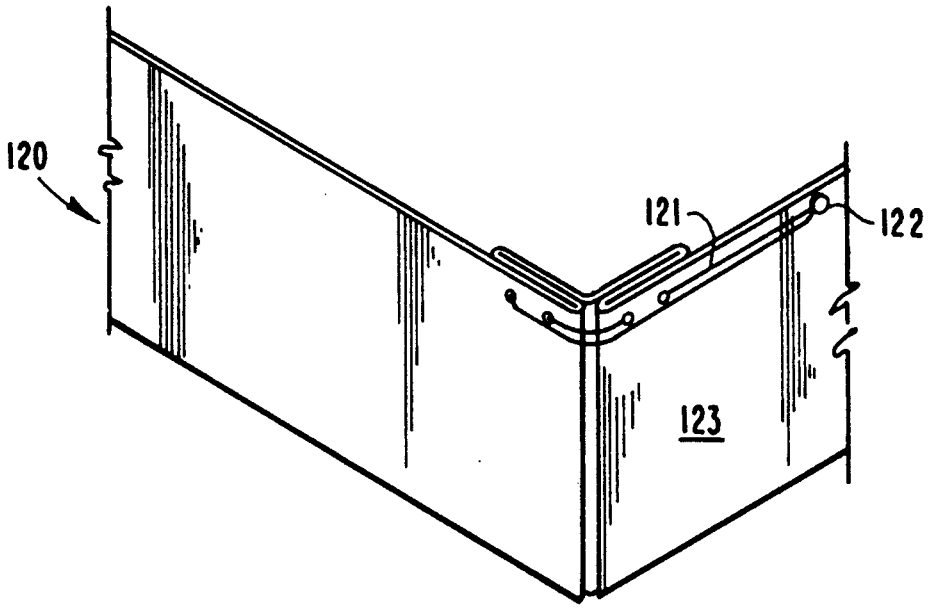
FIG. 18 is a perspective view of the FIG. 17 container corner.

Referring to FIGS. 15 and 16, these drawings illustrate a slight modification to what has just been described with regard to FIGS. 13 and 14. In lieu of a single button 99 on the underside of base panel 96, two buttons 100 and 101 are provided along the lower portion of side panels 102 and 103, respectively. As strap 104 is threaded through the illustrated corner including the normal threading through of the corresponding side panels and folded corner sections, it is to be understood that strap 104 includes rings 105 on each free end which are drawn tightly and hooked over the corresponding buttons.

It should also be understood with regard to FIGS. 13, 14, 15 and 16, that the rings as previously described with regard to FIGS. 11 and 12 can be eliminated from the free ends of the corresponding straps. While the buttons will still be utilized in the manner illustrated, such as on the underside of base panel 96 with regard to the FIG. 13 and FIG. 14 embodiment or on the lower corner portions of side panels 102 and 103 as illustrated in FIGS. 15 and 16, these buttons may be utilized simply as a tie-off or anchor post for the free ends of the strap to be wrapped around and tied. It should also be understood that the various buttons described in FIGS. 11–16 can either be assembled in advance to the corresponding panels or once the corresponding strap is threaded through the corner and pulled tight and ready for securement, the buttons can be inserted at the appropriate location through the rings in the ends of the strap in order to secure the strap in a tightly secured fashion.

Referring to FIGS. 17, 18, 19 and 20, each corner of container 120 is secured by means of a single strap or string which is threaded through the triple-thick lamination of side panel and corner sections as previously indicated in the normal manner as previously described. Once the threading of the illustrated corner is completed, there will be two free ends of string 121 which must be secured in some fashion in order to hold the folded-up configuration. In the illustrated embodiment of FIGS. 17–20, the two free ends are tied together so as to create in the single length of string or strap a loop form of endless nature. This loop is then held tight by means of button 122 which is rigidly held by side panel 123. As with earlier descriptions, button 122 may be previously inserted and anchored into side panel 123 or it may be added after the loop form for string 121 is created so that a more precise placement can be determined in order to keep the string tight.

Figure 19:
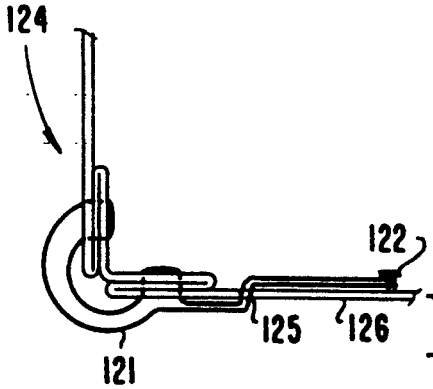
FIG. 19 is a diagrammatic top plan view of one corner of the FIG. 1 container illustrating an alternative securing method.
Figure 20:
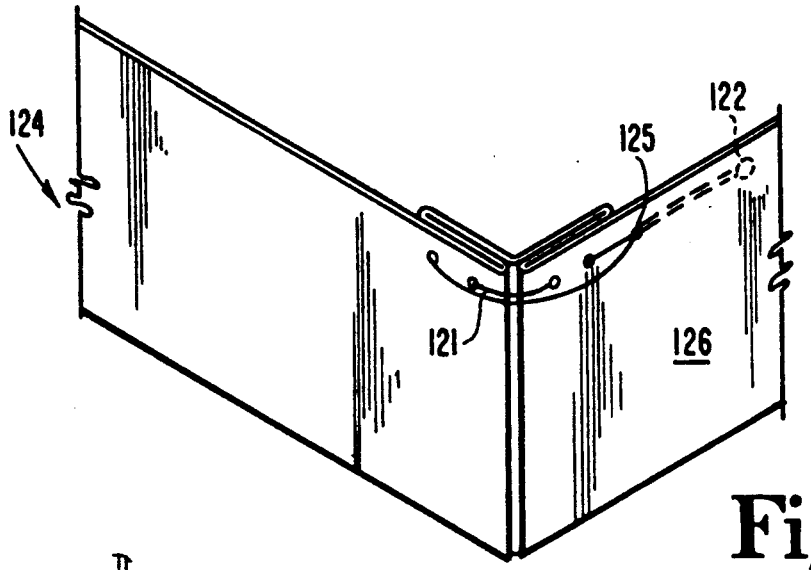
FIG. 20 is a perspective view of the FIG. 19 container corner.

With reference to FIGS. 19 and 20 container 124 is virtually identical to container 120 except that an extra aperture 125 is disposed in side panel 126. This extra aperture allows the string 121 to be threaded from the outside of panel 126 to the inside such that button 122 may be inserted on the inside and thus eliminate access to the securing means from the outside of the container. This alternative approach of placing the button on the inside of the side panel as opposed to the outside may be desirable in certain situations where the outside of the container 120 or 124 is going to be brushed or may come in contact with other surfaces that might tend to abraid or rub off such that the button would come loose and the container at least at the affected corner would tend to collapse.

Figure 21:
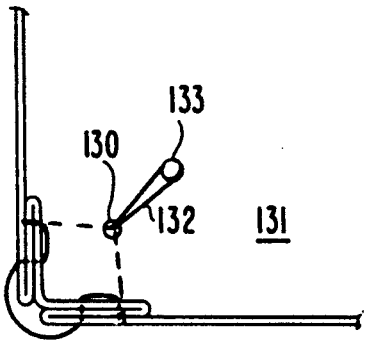
FIG. 21 is a diagrammatic top plan view of one corner of the FIG. 1 container illustrating an alternative securing method.
Figure 22:
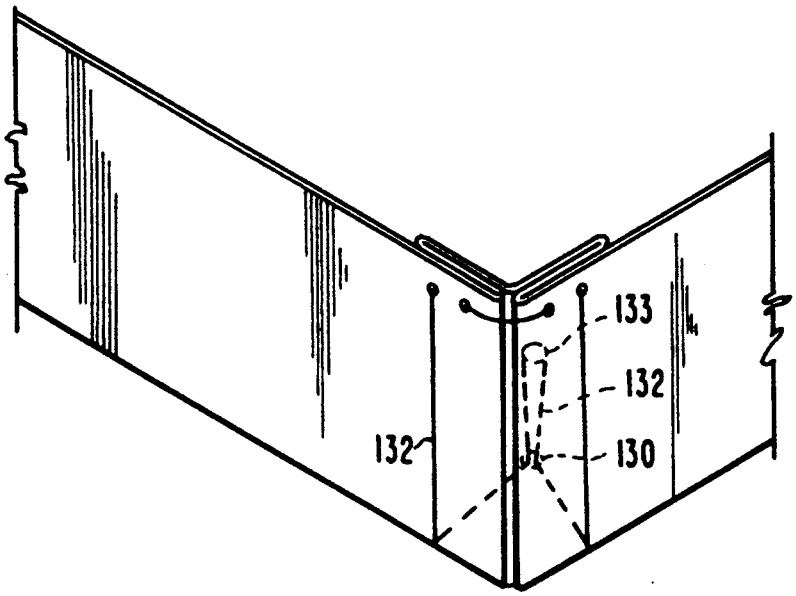
FIG. 22 is a perspective view of the FIG. 21 container corner.
Figure 23:
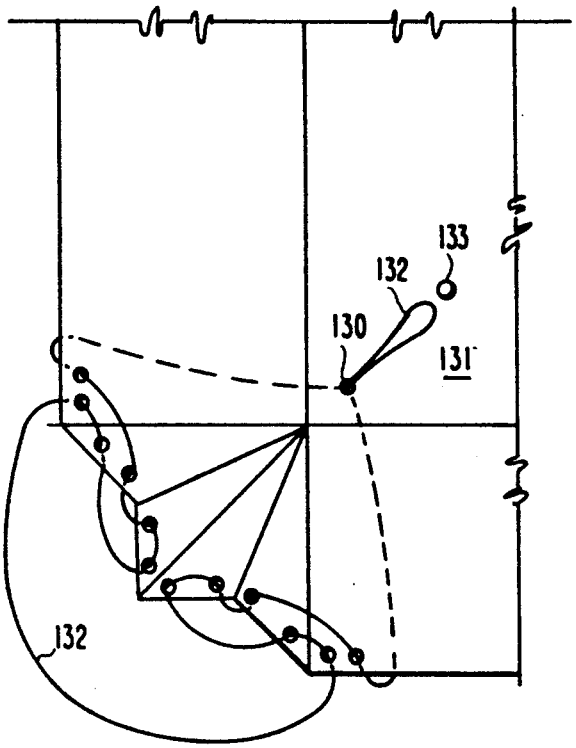
FIG. 23 is a top plan view of one corner of the FIG. 1 container illustrating the alternative securing approach of FIG. 21.

With reference to FIGS. 21–25, further embodiments utilizing some of the foregoing concepts are illustrated. Due to the extensive similarity to earlier described concepts, these five illustrations will be described only very briefly. In FIG. 21, an extra hole or aperture 130 is provided in base panel 131 such that the string 132 which is of a continuous loop form may be threaded through aperture 130 so as to extend on the inside of the container on the top surface of bottom panel 131. This continuous loop or string 130 hooks over button 133 and as previously described, the button may be installed in the base panel before the loop is formed or installed after so as to draw the string (cord, strap or cable) tight. The FIG. 22 illustration shows how the string 132 extends down the two side panels and travels underneath the container so as to pass into the aperture on 130. With regard to FIG. 23, the specific threading of cable 132 through the various side panels and corner sections is illustrated in a top plan view and somewhat of an exploded view form with broken line delineations to point out the travel of the string 132 when it is hidden from view. This particular drawing better illustrates the position of aperture 130 relative to base panel 132 and the location of the button 133. As can be seen, as the continuous loop of string 132 is pulled tight as it is stretched toward button 133, the various side panels and corner sections are folded upright so as to create the folded-up corner configuration of FIG. 22.

Figure 24:
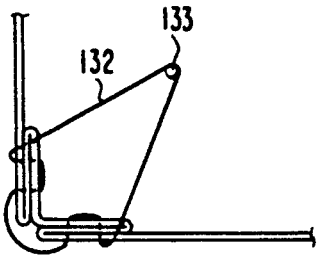
FIG. 24 is a diagrammatic top plan view of one corner of the FIG. 1 container illustrating an alternative securing method.
Figure 25:
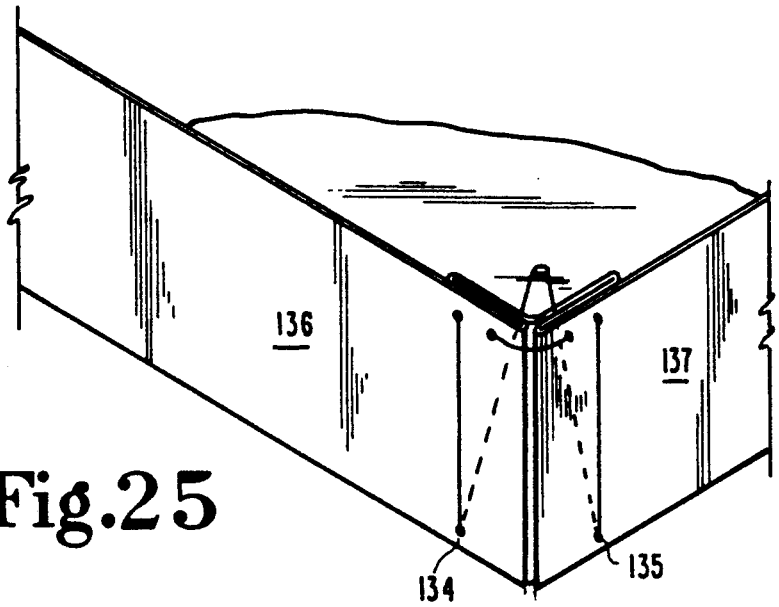
FIG. 25 is a perspective view of the FIG. 24 container corner.

In the illustration of FIGS. 24 and 25, additional apertures 134 and 135 are provided in side panels 136 and 137, respectively, thereby eliminating the need for aperture 130 in the base panel. The difference is the need for two apertures, one in each side panel for each corner, but the net effect is the same, namely to allow the continuous loop of string 132 to pass to the inside surface of the base panel for attachment to or around button 133.

Figure 26:
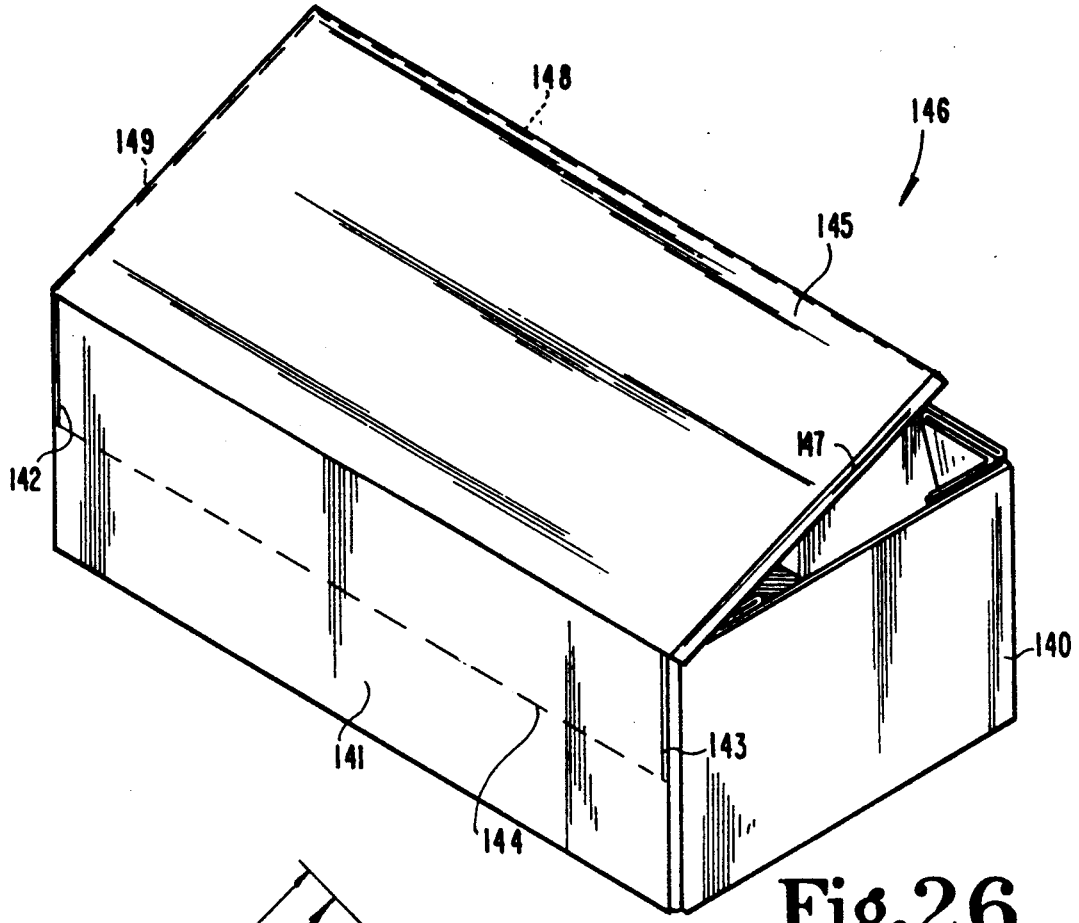
FIG. 26 is a perspective view of a box configuration combining the FIG. 1 container with a lid which is integral therewith and foldable into the illustrated three-dimensional form from an originating flat form.

Referring to FIG. 26, the container configuration of FIGS. 1 and 2 is illustrated with one minor addition. It is also to be understood that the container illustrated in FIG. 26 could in effect be any of the container styles previously described and in order to make the embodiment of FIG. 26 applicable to any of the various cord or strap configurations previously described, nothing has been illustrated as to the means of securing so as to suggest that the embodiment of FIG. 26 can be utilized with any of the foregoing securement techniques. What is disclosed in FIG. 26 is the addition of a lid for the container which can be part of the flat form of FIG. 1 by making certain modifications to one side panel as will be described. Container 140 includes the normal configuration of side panels and corner sections except that side panel 141 is of a slightly modified form. Side panel 141 includes two cuts or slits 142 and 143 and an extra score line 144 which is approximately half way up side wall 141 as illustrated by the broken line in FIG. 26. The portion of side panel 141 above score line 144 is continuous with the top surface 145 of the lid 146 as are edge panels 147, 148 and 149. The three edge panels 147–149 although originating as a flat form configuration are folded in such a manner as to fit down and over the side panels and corners of container 140. Score line 144 allows the lid and the upper portion of side panel 141 to flip back away from the container so as not to interfere with any of the straps or cords used to secure the container in its folded-up configuration. This flip-back arrangement for the lid and the upper half of side panel 141 also enables the easier loading and unloading of the container. Another option with this particular configuration is to prefold the edge panels 147, 148 and 149 and securely join the two corners such that the lid 146 remains in its folded configuration. It is also possible to fold the side panels of container 140 and the corner panels and sections inwardly so as to create a generally rectangular configuration slightly undersized to that of the lid 146. In this arrangement, the lower half of side panel 141 would fold inwardly and the upper half would fold outwardly so as to overlap the bottom half. Once this fan-fold configuration has occurred with regard to side panel 141, the lid can actually fit down over the collapsed and folded-in configuration of the container so as to make a neat and easily handled package and while it has a slightly greater thickness than the flat form of the container in FIG. 1, where the side panels and corner panels are folded outwardly, the folded-in configuration and packaged bundle of FIG. 26 occupies less surface area.

Figure 27:
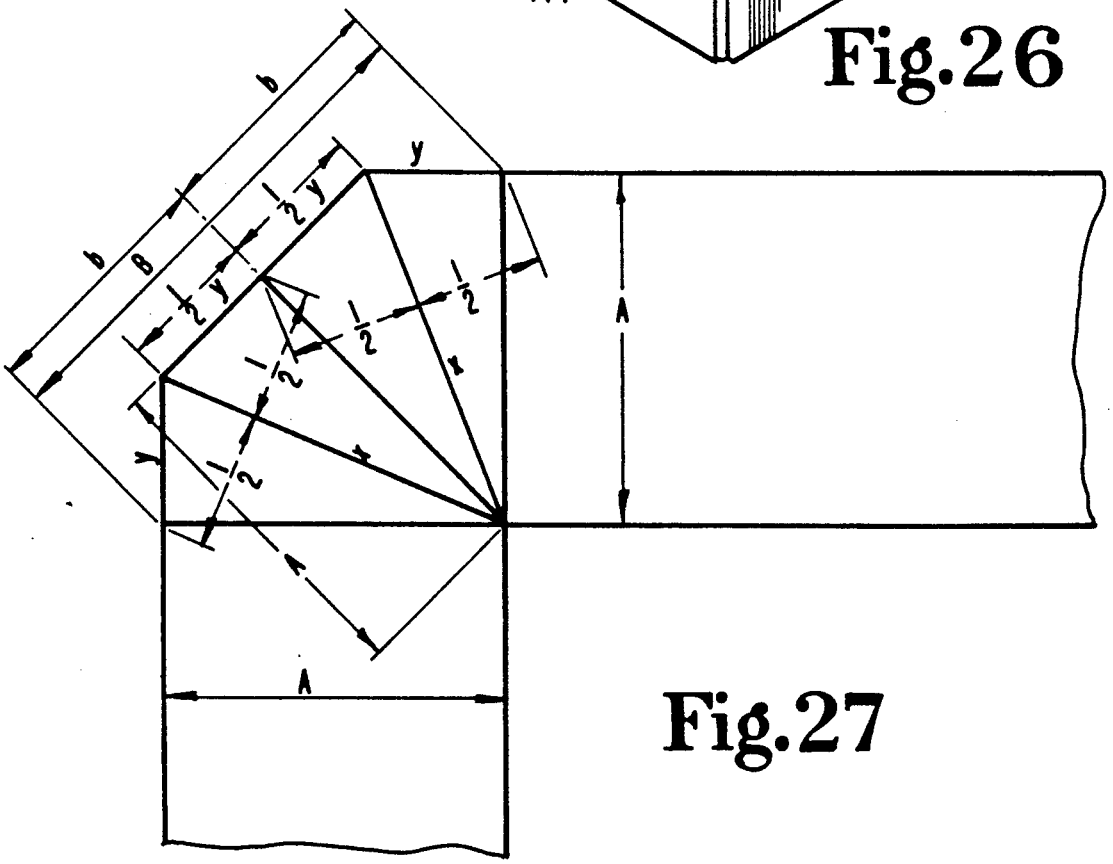
FIG. 27 is a schematic illustration of one corner of the FIG. 1 container illustrating the geometric relationships of the various triangular sections.

Referring to FIG. 27, the geometric relationship of the side panels and corner sections is illustrated. The side panel height or width is illustrated as length A and dimension B is determined by taking the square root of $2A^2$. Dimension X is obtained by selecting the size of the supporting triangle and dimension Y is equal to the square root of $(X^2-A^2)$. This particular geometric relationship and dimensional configuration for the corner panel relative to the two side panels is maintained throughout all of the illustrated and described embodiments.

Figure 28:
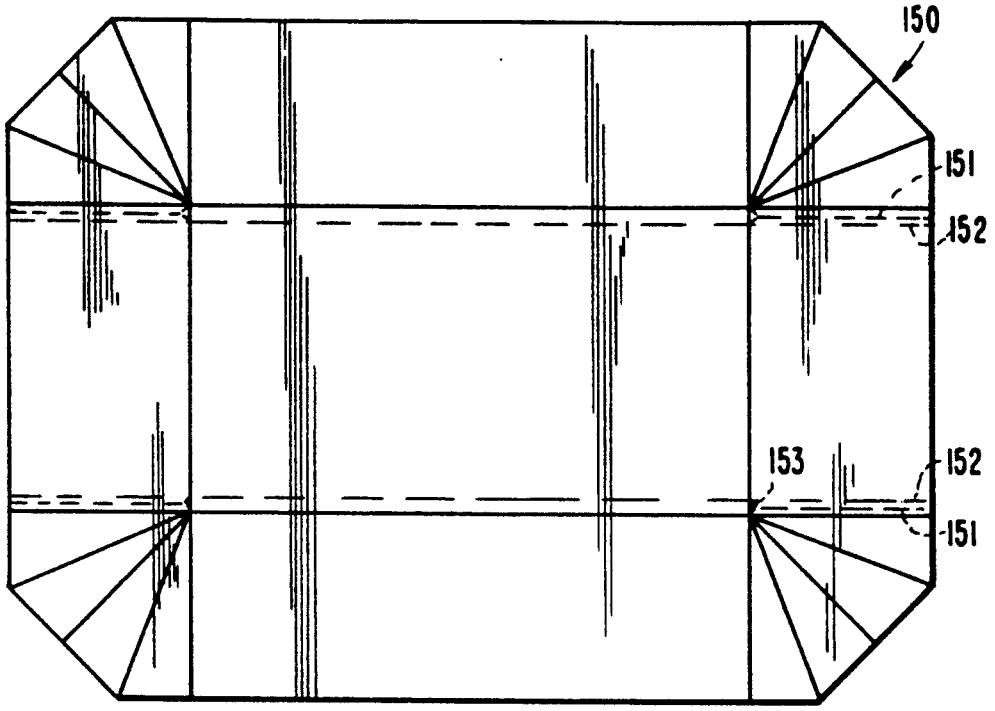
FIG. 28 is a top plan view of an alternative construction approach for the FIG. 1 container with additional score lines provided to avoid corner interference.

Referring to FIG. 28, a slight modification is illustrated wherein container panel 150 includes additional score lines 151 and 152 symetrically occurring as illustrated and additional triangular or wedge-shaped score lines 153 as illustrated between each corner panel and the opposite side panels. Although the folding up of the side panels and corner panels and corner sections as previously described is easily performed with materials of nominal thickness, there may be those container designs which by desire or necessity will incorporate thicker material. In those instances due to the number of folds being made, it is possible that some bunching or interference might occur. By the use of additional score lines as illustrated in FIG. 28, the folding of the sides and corner sections is made easier and precludes the likelihood of material bunching or interference where the multiple folds converge.

Figure 29:
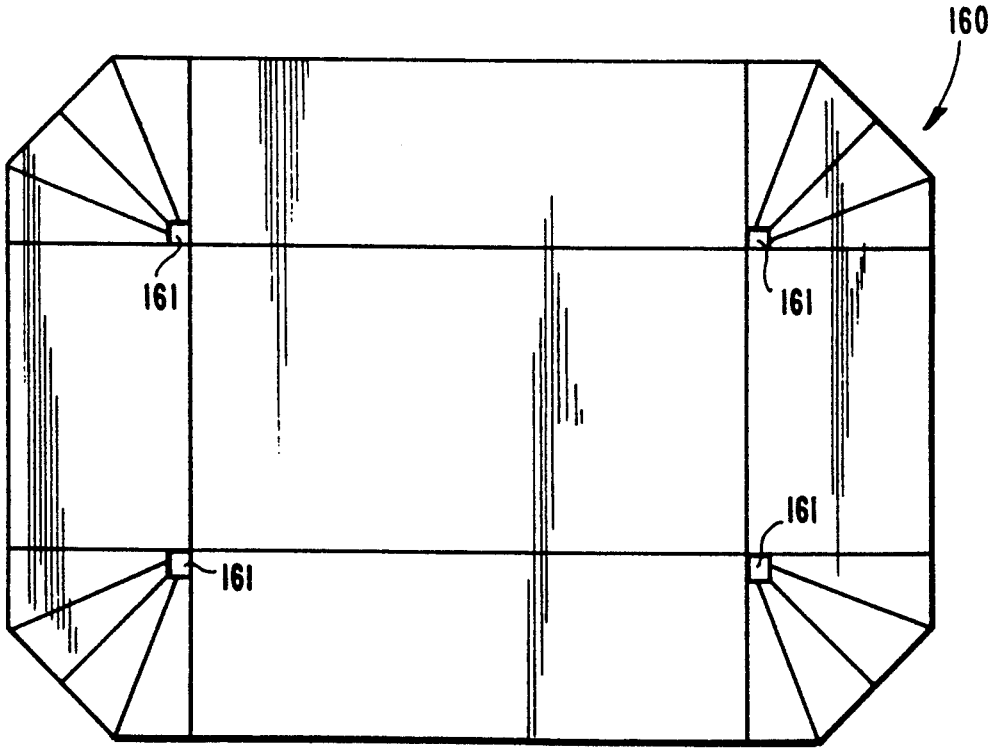
FIG. 29 is a top plan view of an alternative construction approach for the FIG. 1 container utilizing corner relief in order to avoid fold interference.

An alternative to the foregoing elimination of fold bunching or interference is provided by the illustration of FIG. 29 wherein container 160 includes corner relief 161 at the apex of each triangular section of each corner panel. The relief provided is in the form of a substantially square aperture 161 which is bounded on two sides by the score lines defining the base panel and side panels. This particular arrangement may be used when the finished folded-up container does not have to be liquid-tight.

Figure 30:
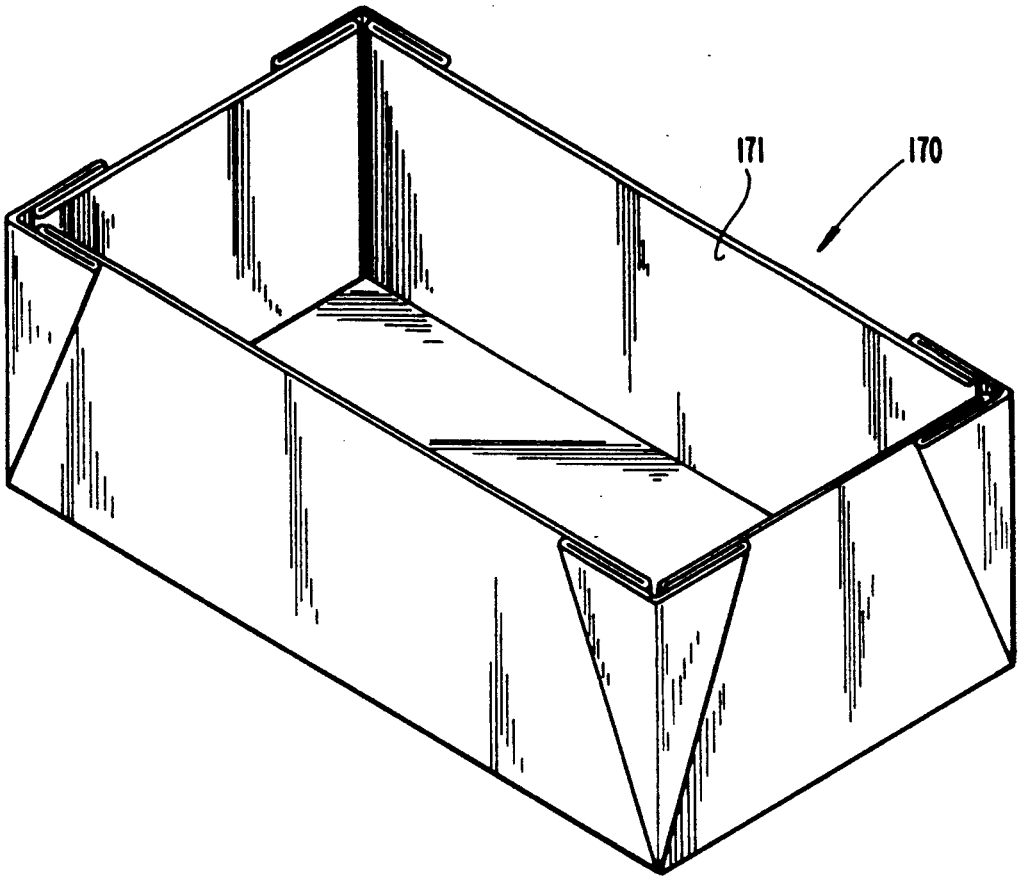
FIG. 30 is a perspective view of the FIG. 1 container illustrating an alternative folding approach for the four corners to enable insulation material to be placed internally.

Referring to FIG. 30, another embodiment of the present invention is illustrated wherein container 170 is folded in such a manner that the various corner sections of each corner panel are folded outwardly rather than inwardly so as to provide a smoother interior configuration without any edge or thickness variations as would occur with regard to the illustration of FIG. 2, for example. As would be noted in FIG. 2, the manner in which the corner sections are folded create thicknesses of corner panel material at the interior surface of the finished container. When those corner thicknesses of material are not desired on the interior of the container, those corner sections may be folded in a reverse manner so as to place the panels or thicknesses of corner section material on the outside of the container as is illustrated in FIG. 30. What this accomplishes is to leave or provide a smooth rectangular solid interior for the container and enables the utilization of an insulated box 171 which can now be snugly placed down into the upright container without interference and thus the container can be used for contents which must be kept cold, or hot, as the case may be and when the use is completed the insulated box 171 can be removed and the container 170 collapsed back into flat form and either reused in this manner or used in the manner FIG. 2. Straps and cords have been eliminated from the illustration of FIG. 30 in order to suggest that virtually any of the foregoing arrangements can be utilized.

Figure 33:
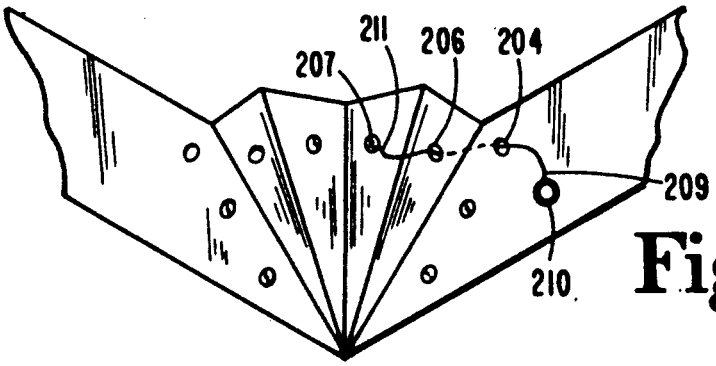
FIG. 33 is a partial perspective view of one unfolded corner of the FIG. 31 container.
Figure 31:
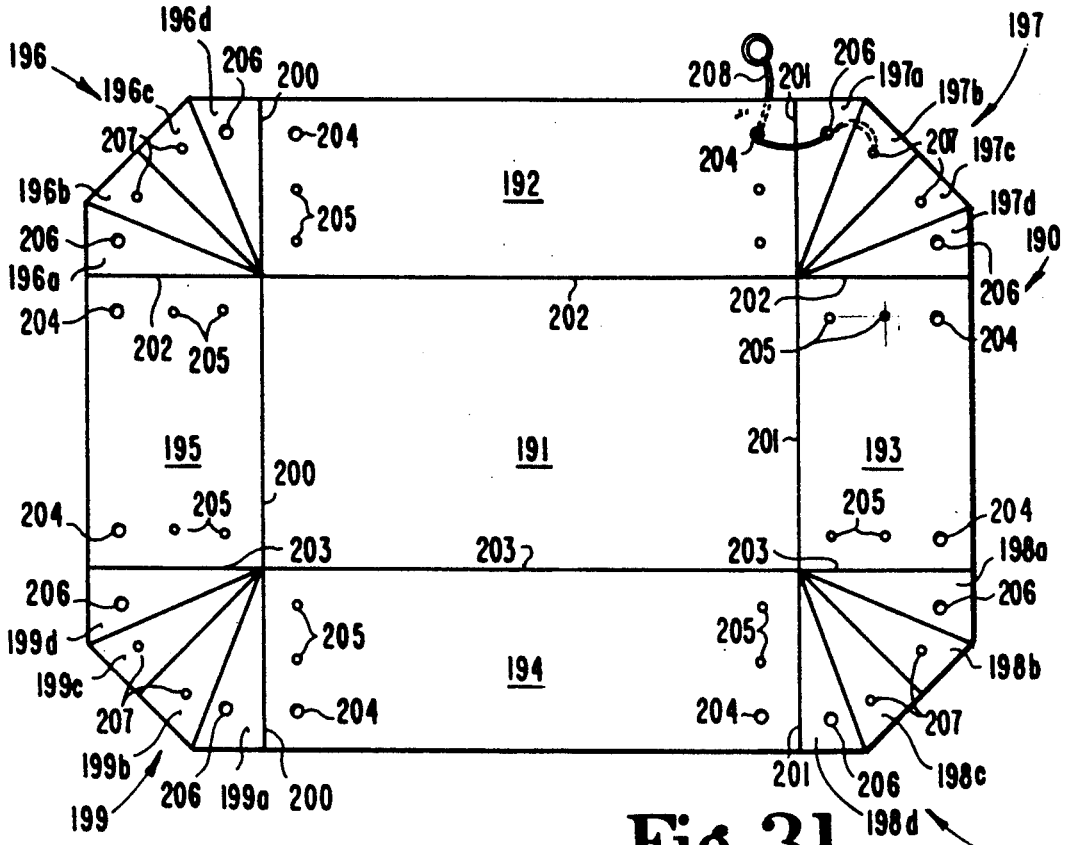
FIG. 31 is a top plan view in flat form, unfolded condition of a fold-up and knock-down container according to a typical embodiment of the present invention.
Figure 32:
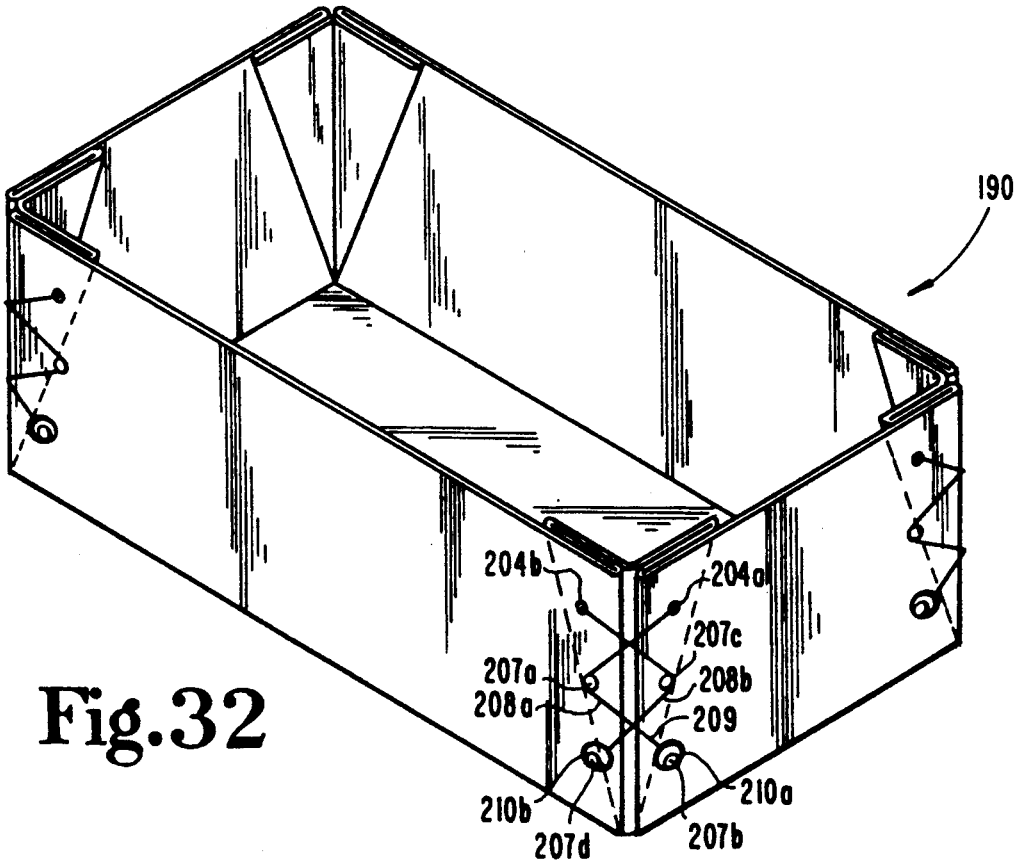
FIG. 32 is a perspective view of the FIG. 31 continer in a folded-up and secured three-dimensional form.

Referring to FIGS. 31–33, there is illustrated another embodiment of the present invention in the form of container 190 which begins in a flat form (FIG. 31) and is arranged with a generally rectangular base panel 191, four generally rectangular side panels 192–195 and four corner panels 196–199. Each corner panel is configured with four generally triangular sections which are defined by score lines. The various triangular sections 196*a*–196*d*, 197*a*–197*d*, 198*a*–198*d* and 199*a*–199*d* are identified by lower-case letters using the base number of the corresponding corner panel. A plurality of substantially parallel and substantially perpendicular score lines 200, 201, 202 and 203 define the base panel, side panels and corner panels.

Each side panel includes two corner through holes 204 and four support posts 205. The two outer triangular corner sections "a" and "d" each include a through hole 206 and the two inner triangular corner sections "b" and "c" each include a support post 207. The method of threading each corner with a pair of flexible ties such as strap 208 is partially illustrated in FIG. 31 with reference to corner section 196 and more fully illustrated in FIGS. 32 and 33. There are a total of eight straps, two per corner, and each is secured by first attaching free end 209 to ring 210 and threading the opposite end 211 first through hole 204 of the corresponding side panel, then into hole 206 of the adjacent triangular corner section either "a" or "d" and finally securing end 211 to the support post 207 of the adjacent triangular corner section either "b" or "c," respectively (see FIG. 33).

The two support posts located in each end of each side panel are used for alternate lacing of the two straps 208. Referring to FIG. 32, strap 208*a* coming out of hole 204*a* laces around post 207*a* and then ring 210*a* hooks over post 207*b*. On the other side of the same corner, strap 208*b* coming out of hole 204*b* laces around post 207*c* and then ring 210*b* hooks over post 207*d*.

The final folded-up configuration of container 190 is illustrated in FIG. 32 showing the reinforced corners achieved by the lamination of three thicknesses on each side.

Although the structure of the present invention has been described as a container it is not limited to that function. The concepts disclosed herein may be used in the construction of toy houses, shelters for the homeless, a removable suitcase liner for supplemental storage, etc.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A fold-up and knock-down structure which begins in a flat form and can be manually folded into an upright configuration and unfolded back into said flat form comprises:

a main body arranged with a plurality of panels defined by score lines which denote folds to be made in the main body, the plurality of panels including a base panel, four side panels and four corner panels, each of the four corner panels being arranged with a plurality of sections defined by score lines which denote folds to be made in the corresponding corner panel;

flexible securement means threaded through each of said corner sections for drawing together and securing the corner sections of each corner panel; and said sections of each corner panel being arranged such that in the folded, upright configuration each corner of the structure having three thicknesses.

2. The structure of claim 1 wherein each corner panel includes four corner sections.

3. The structure of claim 1 wherein said flexible securement means includes a single length strap threaded through and around the perimeter of said side panels.

4. The structure of claim 1 wherein said flexible securement means includes two lengths of cable.

5. The structure of claim 1 wherein said flexible securement means includes four separate lengths of cable material.

6. The structure of claim 1 wherein said flexible securement means eight separate lengths of cable material.

7. The structure of claim 1 wherein said flexible securement means includes a length of cable material with the free ends joined so as to create an endless loop.

8. The structure of claim 1 which further includes rigid securement means attached to said main body and designed and arranged to receive a portion of said flexible securement means.

9. The structure of claim 8 wherein said rigid securement means includes an anchored post.

10. The structure of claim 1 wherein said flexible securement means includes a length of strap material having rigid members adjacent each end wherein one rigid member is a washer and the other rigid member is a slide choker.

11. The structure of claim 1 which further includes a lid integrally disposed as part of one side panel and designed and arranged so as to fold over and cover said structure with said structure in a folded-up configuration.

12. The structure of claim 1 which further includes a fold-relief aperture adjacent the intersection of each corner panel and the two bounding side panels to each corresponding corner panel.

13. A fold-up and knock-down structure which begins in a flat form and can be manually folded into an upright configuration and unfolded back into said flat form comprises:

a main body arranged with a plurality of panels defined by score lines which denote folds to be made in the main body, the plurality of panels including a base panel, four side panels and four corner panels, each of the four corner panels being arranged with four corner sections defined by score lines which denote folds to be made in the corresponding corner panel; and flexible securement means threaded through each of said corner sections for drawing together and securing the corner sections of each corner panel.

14. A fold-up and knock-down structure which begins in a flat form and can be manually folded into an upright configuration and unfolded back into said flat down comprises:

a main body arranged with a plurality of panels defined by score lines which denote folds to be made in the main body, the plurality of panels including a base panel, four side panels and four corner panels, each arranged with a plurality of sections defined by score lines which denote folds to be made in the corresponding corner panel; and flexible securement means including eight separate lengths of cable material threaded through said corner sections for drawing together and securing the corner sections of each corner panel.

15. A fold-up and knock-down structure which begins in a flat form and can be manually folded into an upright configuration and unfolded back into said flat form comprises:

a main body arranged with a plurality of panels defined by score lines which denote folds to be made in the main body, the plurality of panels including a base panel, four side panels and four corner panels, each of the four corner panels being arranged with a plurality of sections defined by score lines which denote folds to be made in the corresponding corner panel;

flexible securement means threaded through each of said corner sections for drawing together and securing the corner sections of each corner panel; and rigid securement means attached to said main body and designed and arranged to receive a portion of said flexible securement means.

16. The structure of claim 15 wherein said rigid securement means includes an anchored post.

17. A fold-up and knock-down structure which begins in a flat form and can be manually folded into an upright configuration and unfolded back into said flat form comprises:

a main body arranged with a plurality of panels defined by score lines which denote folds to be made in the main body, the plurality of panels including a base panel, four side panels and four corner panels, each of the four corner panels being arranged with a plurality of sections defined by score lines which denote folds to be made in the corresponding corner panel; and flexible securement means threaded through each of said corner sections for drawing together and securing the corner sections of said corner panel, said flexible securement means including a length of strap material having rigid members adjacent each end wherein one rigid member is a washer and the other rigid member is a slide choker.

18. A fold-up and knock-down structure which begins in a flat form and can be manually folded into an upright configuration and unfolded back into said flat form comprises:

a main body arranged with a plurality of panels defined by score lines which denote folds to be made in the main body, the plurality of panels including a base panel, four side panels and four corner panels, each of the four corner panels being arranged with four corner sections defined by score lines which denote folds to be made in the corresponding corner panel; and securement means for securing the corner sections of each corner panel into a folded upright configuration.

19. The structure of claim 18 wherein each of said corner sections has a triangular shape.

* * * * *